United States Patent [19]

Koslosky

[11] 4,170,106

[45] Oct. 9, 1979

[54] INFANT'S RATTLE

[76] Inventor: Roberta S. Koslosky, Rte. 1, Box 187, Mt. Shasta, Calif. 96067

[21] Appl. No.: 839,279

[22] Filed: Oct. 4, 1977

[51] Int. Cl.[2] ..... A63H 5/00

[52] U.S. Cl. ..... 46/193; 46/177

[58] Field of Search ..... 46/193, 174, 175 R, 46/177, 191, 1 R; D34/15 C; 84/418

[56] References Cited

U.S. PATENT DOCUMENTS

| | | | |
|---|---|---|---|
| D. 159,667 | 8/1950 | Ross | 46/193 X |
| D. 196,184 | 9/1963 | Renzi | D34/15 C |
| 2,137,651 | 11/1938 | Larrabee | 46/193 |
| 2,774,179 | 12/1956 | Zalkind | 46/175 R X |
| 3,512,301 | 5/1970 | Kramer | 46/175 R |
| 3,710,504 | 1/1973 | Rylands | 46/193 X |

*Primary Examiner*—Russell R. Kinsey
*Assistant Examiner*—Mickey Yu
*Attorney, Agent, or Firm*—Mark C. Jacobs

[57] ABSTRACT

An infant's or child's rattle is disclosed which features capped slideable prongs disposed slidingly within a hub member. The rattle is capable of standing in a plurality of positions.

6 Claims, 2 Drawing Figures

INFANT'S RATTLE

The invention consists of a hub member with prongs which slide in and out of holes, capped on the ends with wooden balls. As an infants rattle and teething ring, the invention teaches one at an early age that they can manipulate objects by themselves. The prongs slide easily in and out and turn in either direction exercising many different muscles in the hands. When the toy is dropped and initially comes to a rest, the balls continue to rock on the prongs for a few seconds. This is an appealing movement and also illustrates several laws of motion which the older child can begin to understand. The balls being constructed of wood, become an excellent teething surface. When shaken, the rattle makes a very pleasant wholesome sound. The toy is safe and has no sharp edges or points.

In describing this invention, reference is had to the accompanying drawing in which like characters designate corresponding parts in all the views.

DESCRIPTION OF PREFERRED EMBODIMENT

Figure 1:
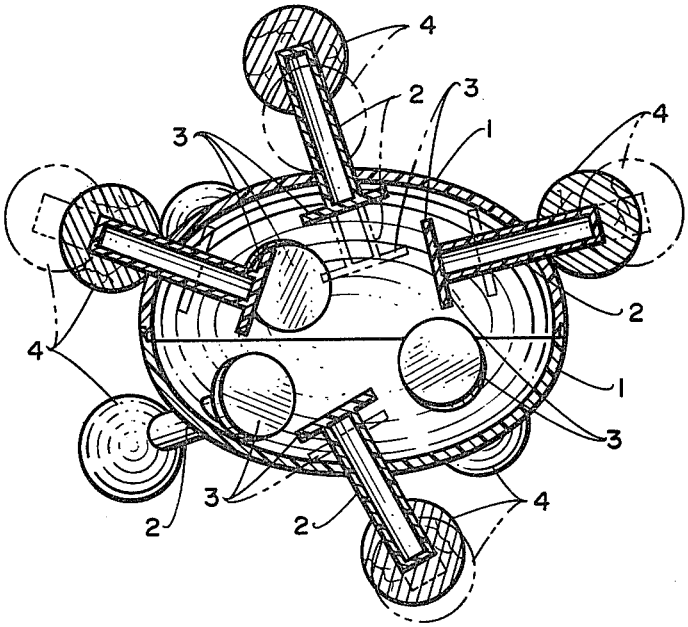
FIG. 1 is a sectional view intersecting 4 of the prongs
Figure 2:
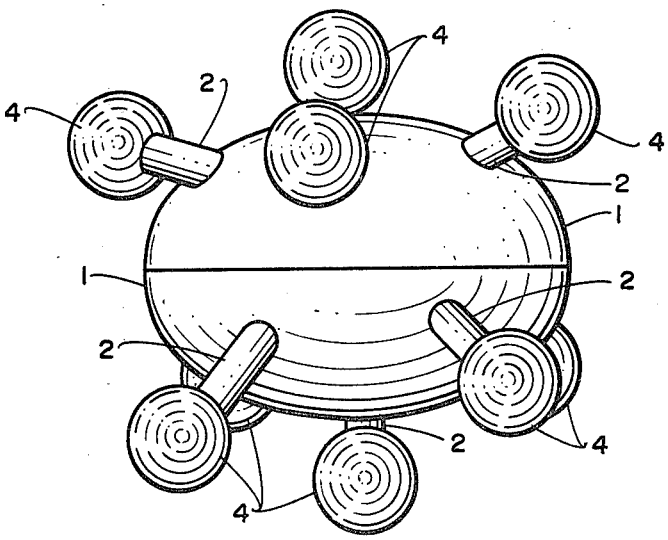
FIG. 2 is a side elevational view of the rattle of this invention.

The toy consists of a hollow plastic hub member 1 preferably ellipsoid in configuration with a plurality of prongs 2, extending through an equal plurality of holes. The prongs may be hollow and made of plastic also.

The prongs are angularly disposed one to the other as can be seen in the drawing. Each has some degree of freedom of orientation front and back, and side to side within the confines of its particular hole since the diameter of the prong is smaller than that of its respective hole to permit rotation and free sliding movement of the prong.

In the preferred embodiment there are four evenly spaced apart disposed outwardly on the same general horizontal plane in each of the top and bottom halves of the hub member, with one prong pointing generally upward in the top half and one pointing generally downward in the bottom half. The construction is such that the rattle of the preferred embodiment will inherently rest on any three adjacent balls disposed on their respective prongs, the spatial relationship of which one to the other to the third forms a triangle. Provided, however, that if one of said balls is the top or bottom ball, all of the balls forming the triangle be above or below the horizontal axis 5 of the elipsoid.

They have a round disk 3 on one end to keep them from sliding out of the hub member and a wooden ball fastened to the other end of each prong. The wooden ball is preferably made of a hard wood and can be painted with a non-lead base paint or left natural. The hub member and prongs may be of a variety of bright colors. The materials from which the invention may be formed are readily available and fabrication of the toy is relatively simple.

Since changes may be made in the above apparatus without departing from the scope of the invention, all matter contained in the description shall be interpreted as illustrative only and not in a limiting sense.

What I claim is:

1. An infant rattle comprising a hollow hub having both a top and bottom half, said hub being elipsoidal in configuration and having a plurality of freely slideably mounted prongs radiating outwardly therefrom, the number of said prongs being evenly distributed between the top and bottom of said hub, wherein each of the top and bottom of said hub have four prongs projecting radially outward equidistantly spaced apart, and a fifth prong uniformly spaced apart from the other four prongs and disposed outwardly from said hub at a right angle to the horizontal axis of said hub.

2. In the rattle of claim 1 wherein each of said prongs has a ball fastened on the outer end thereof.

3. In the rattle of claim 1 wherein each of said prongs has a ball fastened on the outer end thereof.

4. In the rattle of claim 3 wherein each of said prongs is rotatable and slideable.

5. In the rattle of claim 4 wherein said prongs are hollow tubular members.

6. In the rattle of claim 5 wherein said hub and prongs are plastic and said balls are wood.

* * * * *